US007759654B2

(12) United States Patent
Yan et al.

(10) Patent No.: US 7,759,654 B2
(45) Date of Patent: Jul. 20, 2010

(54) APPARATUS FOR GENERATING CORONA DISCHARGES

(75) Inventors: Keping Yan, Geldrop (NL); Egbertus Johannes Van Heesch, Eindhoven (NL)

(73) Assignee: Technische Universiteit Eindhoven, Eindhoven (NL)

( * ) Notice: Subject to any disclaimer, the term of this patent is extended or adjusted under 35 U.S.C. 154(b) by 464 days.

(21) Appl. No.: 11/596,129

(22) PCT Filed: May 4, 2005

(86) PCT No.: PCT/NL2005/000342

§ 371 (c)(1),
(2), (4) Date: Aug. 22, 2007

(87) PCT Pub. No.: WO2005/112212

PCT Pub. Date: Nov. 24, 2005

(65) Prior Publication Data

US 2008/0290277 A1 Nov. 27, 2008

(30) Foreign Application Priority Data

May 13, 2004 (NL) ..... 1026187

(51) Int. Cl.
*H01T 19/04* (2006.01)

(52) U.S. Cl. ..... 250/424; 250/324; 250/423 R

(58) Field of Classification Search ..... 250/324, 250/423 R, 424

See application file for complete search history.

(56) References Cited

U.S. PATENT DOCUMENTS 3,942,093 A 3/1976 Lowther
4,867,765 A 9/1989 Tomimatsu et al.
6,005,880 A * 12/1999 Basting et al. ..... 372/38.04
6,362,604 B1 3/2002 Cravey
2007/0114411 A1 * 5/2007 Yan ..... 250/324

FOREIGN PATENT DOCUMENTS

WO WO-97/18899 5/1987

* cited by examiner

*Primary Examiner*—Jack I Berman
*Assistant Examiner*—Hanway Chang
(74) *Attorney, Agent, or Firm*—Finnegan, Henderson, Farabow, Garrett & Dunner, L.L.P.

(57) ABSTRACT

The invention relates to an apparatus for generating corona discharges, comprising a first assembly, which first assembly is built up of at least one corona discharge space and at least one discharge electrode disposed in the corona discharge space, as well as a high voltage source, an output of which is connected to the at least one discharge electrode. The object of the present invention is to provide an apparatus for generating corona discharges as referred to in the introduction, which apparatus is capable of controlling more corona discharge spaces, using the standard parts and components, and which is also suitable for high power levels, therefore. According to the invention, the apparatus comprises at least one further assembly, which at least one further assembly is likewise built up of at least one corona discharge space and at least one discharge electrode disposed in the corona discharge space, which at least one discharge electrodes of the respective assemblies are electrically interconnected by means of a switching element.

26 Claims, 12 Drawing Sheets

APPARATUS FOR GENERATING CORONA DISCHARGES

Figure 1:
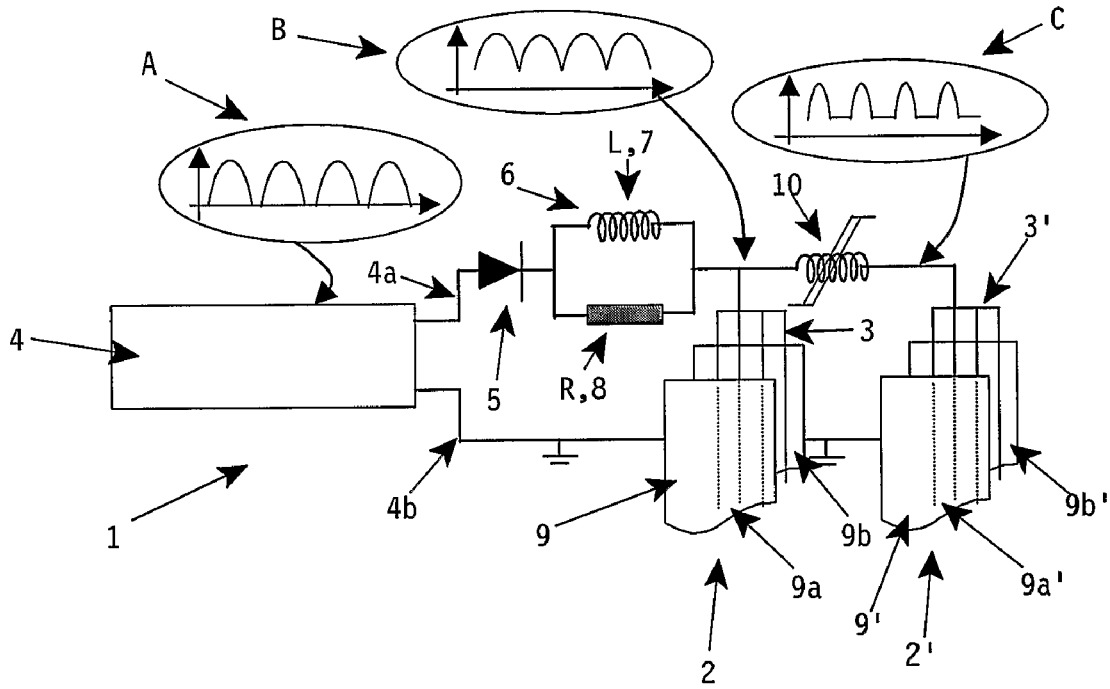

The invention relates to an apparatus for generating corona discharges, comprising a first assembly, which first assembly is built up of at least one corona discharge space and at least one discharge electrode disposed in the corona discharge space, as well as a high voltage source, an output of which is connected to the at least one discharge electrode.

In the present patent application, the term "corona discharges" is understood to include positive as well as negative corona discharges.

Such an apparatus is disclosed in, for example, International patent application WO 97/18899. Said publication discloses a specific application for treating gases or liquids, in which use is made of pulsed corona discharges. Pulses of a few dozen kV are converted into very rapidly rising pulses from the high voltage source and supplied to the corona discharge space via the discharge electrode.

To obtain an adequate, controlled generation of the pulsed corona discharges in the corona discharge space, WO 97/18899 employs so-called spark gaps built up of heavy electrodes of complex construction, which are costly, therefore. Said complex construction is necessary, on the one hand because of the high voltage signals that are used, but also in order to ensure a relatively long life span. In addition to the fact that the life span of a spark gap is usually limited, the usability of the apparatus as referred to in the introduction is also limited by the maximally attainable pulsed power that the high voltage source can supply to the corona discharge space.

Higher pulsed power levels can be obtained by using several corona discharge spaces. However, the use of several corona discharge spaces also requires more powerful and costlier high-voltage sources, which are usually not available.

Consequently, the object of the present invention is to provide an apparatus for generating corona discharges as referred to in the introduction, which apparatus is capable of controlling more corona discharge spaces, using the standard parts and components, and which is also suitable for high power levels, therefore.

According to the invention, the apparatus comprises at least one further assembly, which at least one further assembly is likewise built up of at least one corona discharge space and at least one discharge electrode disposed in the corona discharge space, which at least one discharge electrodes of the respective assemblies are electrically interconnected by means of a switching element.

This construction makes it possible to pass higher power levels through the apparatus while using the standard components, thus enabling an upscale of the apparatus to render it suitable for high-power corona discharges whilst retaining the existing standard high-voltage source.

In a special embodiment, the switching element is configured as a magnetic switching element, which magnetic switching element may comprise a magnetic core material as well as one or more electrical windings wound around the core. This prevents the high-voltage source being loaded by all the assemblies of corona discharge spaces. On the other hand, the discharge electrode(s) of the first assembly is (are) directly driven by the high-voltage source, but the magnetic switching element is charged to a desired discharge voltage by the high-voltage source, after which the discharge voltage is passed on to the discharge electrode(s) of the next assembly.

More specifically, the magnetic core material is pre-magnetised, and even more specifically the pre-magnetisation of the magnetic core material is adjustable. This makes it possible to control or influence the charging characteristic of the switching element and thus way the discharge electrode(s) of the next assemblies are driven. The adjustment of the pre-magnetization may take place via an additional external power source or via the current intensity of the voltage signal delivered by the high-voltage source. This helps to reduce the dimensions of the magnetic switching element, which is desirable also for economic reasons.

In a specific embodiment, a further switching element is connected between the high-voltage source and said at least one discharge electrode; more in particular, a coupling capacitor is connected between the high-voltage source and said further switching element. The capacitance C of the coupling capacitor may range from 2 nF to 100 nF.

The coupling capacitor realises a DC high-voltage component, on which the high-voltage source superposes an AC high-voltage component or a pulsed high-voltage component.

In another functional embodiment of the apparatus according to the invention, a DC voltage source is connected in the apparatus comprises in combination with the coupling capacitor. By connecting the DC voltage source to a discharge electrode of a corona discharge space of an assembly, a DC high-voltage component is realised on which an AC high-voltage component or a pulsed high-voltage component is superposed. Thus, it is easier to control and adjust the time of discharging under the influence of the preceding assembly in the apparatus.

Furthermore, a coupling inductor whose inductance L ranges from 1 mH to 1000 mH may be connected between the DC voltage source and the discharge electrode. The coupling inductor blocks the frequencies in the high-voltage signals and thus prevents the DC voltage source from being influenced or damaged by the frequency pulses of the AC high-voltage signal or the pulsed high-voltage signal delivered by the high-voltage source.

In a special embodiment of he apparatus according to the invention, at least one element having diode functionality is connected between the high-voltage source and said at least one discharge electrode of the first assembly, which element delivers a DC high-voltage component with an AC high-voltage component superposed thereon on the discharge electrode. These characteristics make it possible to use the apparatus for so-called positive "streamer" corona discharges.

The apparatus can furthermore be built up of simple components, which not only render the apparatus less complex and costly but, in addition, have a longer life and furthermore make it possible to transmit higher power levels.

In a specific embodiment, by which the corona discharge space can be controlled in a simple, reliable manner, the element having diode functionality is a semiconductor, e.g. a rectifier, a transistor, a diode or a thyristor.

In a special embodiment, the element having diode functionality is configured as a single-phase rectifier, whilst in another embodiment it may be configured as a bridge rectifier.

In a special embodiment, the element having diode functionality is connected in series with an LR-circuit, which LR-circuit is connected to the at least one discharge electrode of the first assembly. As a result, an activation signal having a DC high-voltage component with an AC high-voltage component superposed thereon is delivered on the discharge electrode in an adequate and simple manner, and more in particular it is possible to adjust the inductance value L of the LR-circuit. More in particular, the impedance value L ranges from 1 mH to 1000 mH. The LR-circuit may be a series circuit or a parallel circuit.

More specifically, the DC high voltage is 10-60 kV, more in particular 5-35 kV, whilst the frequency of the AC high voltage is 0.1-100 kHz, more in particular 5-30 kHz.

More specifically, in one embodiment the high-voltage source is an inductive coupling pulse converter, which, in a special embodiment, is connected between the discharge electrode and the DC voltage source. The winding ratio of the inductive coupling pulse converter may range between 1 and 100.

In a specific functional embodiment, the high-voltage source is an AC/DC pulse converter, and more specifically, in another embodiment the high-voltage source is an AC/DC/AC converter.

In one embodiment according to the invention, each corona discharge space of each assembly is built up of at least two parallel, electrically earthed plates, between which plates the at least one discharge electrode extends in parallel relationship therewith.

The invention will now be explained in more detail with reference to a drawing, in which:

FIGS. 1-12 show various embodiments of an apparatus according to the invention.

For a clear understanding of the invention, like parts will be indicated with the same numerals in the description of the figures below.

In FIG. 1, a first embodiment of an apparatus for generating corona discharges according to the invention is shown. The apparatus 1 comprises a first assembly 2, which is built up of a discharge electrode 3 that is placed in a corona discharge space, which is connected to the earth potential 12. In this embodiment, the corona discharge space 9 is made up of two spaced-apart metal plates 9*a* and 9*b* arranged in parallel relationship. The apparatus 1 furthermore comprises a high-voltage source 4, which delivers a high voltage to an element having diode functionality via its two output terminals 4*a* and 4*b*, which element is in turn connected to the discharge electrode 3 of the first assembly 2 via an LR-circuit 6. The high-voltage source 4 delivers a high-voltage signal on the two output terminals 4*a* and 4*b*, as is indicated at A.

The element 5 having diode functionality is connected in the apparatus in such a manner that the AC voltage signal A that is applied to the output terminals 4*a* and 4*b* by the high voltage source 4 will have the waveform that is shown in the enlarged left-hand detail view A in FIG. 1. Since the AC voltage signal is superposed on a DC voltage signal, the element 5 having diode functionality, in combination with the LR-circuit 6, causes a voltage signal having the waveform that is shown in the detail view B to be applied to the discharge electrode 3.

The element 5 having diode functionality may be a semiconductor element, which is configured as a rectifier, a transistor, a diode or a thyristor, for example. In FIG. 1, the element 5 having diode functionality is configured as a single-phase rectifier. In this case the LR-circuit is configured as a parallel circuit made up of a resistor 8 having a resistance value R and an inductance 7 having an inductance value R that ranges from 1 mH to 1000 mH.

The AC voltage signal B that is applied to the discharge electrode 3 of the first assembly 2 results in corona discharges in the corona discharge space 9 formed by the plates 9*a* and 9*b*.

According to the invention, the apparatus 1 comprises a further assembly 2', which assembly 2' is built up of a corona discharge space 9', which is made up of two or more plates 9*a'* and 9*b'* arranged in parallel relationship in this embodiment. A further discharge electrode 3' is arranged between the plates 9*a'* and 9*b'*.

The discharge electrode 3' of the further assembly 2' is connected to the at least one discharge electrode 3 of the first assembly 2 by means of a switching element 10. The switching element 10 may be configured as a magnetic switching element, which may be built up of a magnetic core material and one or more electrical windings wound around said core.

More specifically, the magnetic core material may be pre-magnetised, in which case the pre-magnetization of the magnetic core material may be adjustable. The adjustability of the pre-magnetization may take place via an additional external power source (not shown) or via the current intensity of the voltage signal delivered by the high-voltage source 4. This helps to reduce the dimensions of the magnetic switching element 10, which is desirable also for economic reasons.

The magnetic switching element 10 is charged by the AC voltage signal B that is applied by the discharge electrode 3 until the switching element 10 becomes saturated. At that point, the discharge electrode 3 discharges across the switching element 10 to the discharge electrode 3' of the further assembly 2'. The AC voltage signal C thus generated, which is applied to the further discharge electrode 3', has a much shorter pulse width, as is shown in FIG. 1.

At the beginning of the charging process of the switching element 10 by means of the AC voltage signal B being applied to the discharge electrode 3, the magnetic switching element 2 exhibits a high inductance level, which decreases during said charging until the switching element 10 becomes saturated.

This configuration makes it possible to energise several assemblies 2-2', which are each built up of one or more corona discharge spaces 9-9' and the discharge electrodes 3-3' present in the various discharge spaces, by means of only one high-voltage source 4. Using the apparatus according to the invention, it is thus possible, using a standard high-voltage source having standard specifications, to transmit much higher power levels through several corona discharge spaces by electrically interconnecting the various discharge electrodes 3-3' of the successive assemblies 2-2' by means of a magnetic switching element 10.

Figure 2:
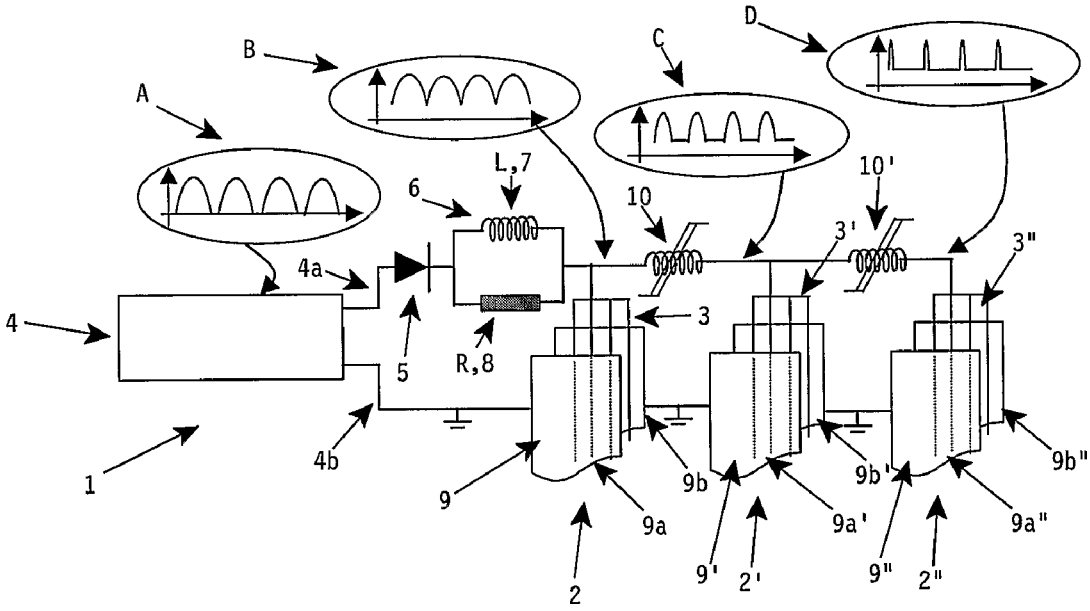

A further upscale of the apparatus 1 according to the invention is shown in the embodiment of FIG. 2, in which the apparatus 1 comprises another assembly 2". Said assembly 2" is likewise built up of at least one corona discharge space 9", in this embodiment made up of at least two plates 9*a"*-9*b"* arranged parallel to each other. At least one discharge electrode 3" is present in said at least one corona discharge space 9".

According to the invention, the at least one discharge electrode 3" of the other assembly 2" is electrically connected to the at least one discharge electrode 3' of the further assembly 2' by means of a further magnetic switching element 10'. Also in this case, the magnetic switching element 10' initially exhibits a high inductance level during operation, but becomes saturated while being charged by the AC voltage signal C being applied to the discharge electrode 3', until the discharge electrode 3' discharges to the discharge electrode 3' via the magnetic switching element 10' in the form of an AC voltage signal D that has an even much shorter pulse time than the AC voltage signal C that will be applied to the discharge electrode 3' of the further assembly 2'.

It will be understood that the embodiments that are shown in FIGS. 1 and 2 can be further extended by adding an additional assembly 2'" to the apparatus, in which case the at least one discharge electrode 3 of each assembly 2 is electrically connected to the at least one discharge electrode of the preceding assembly by means of a magnetic switching element 10'.

Figure 3:
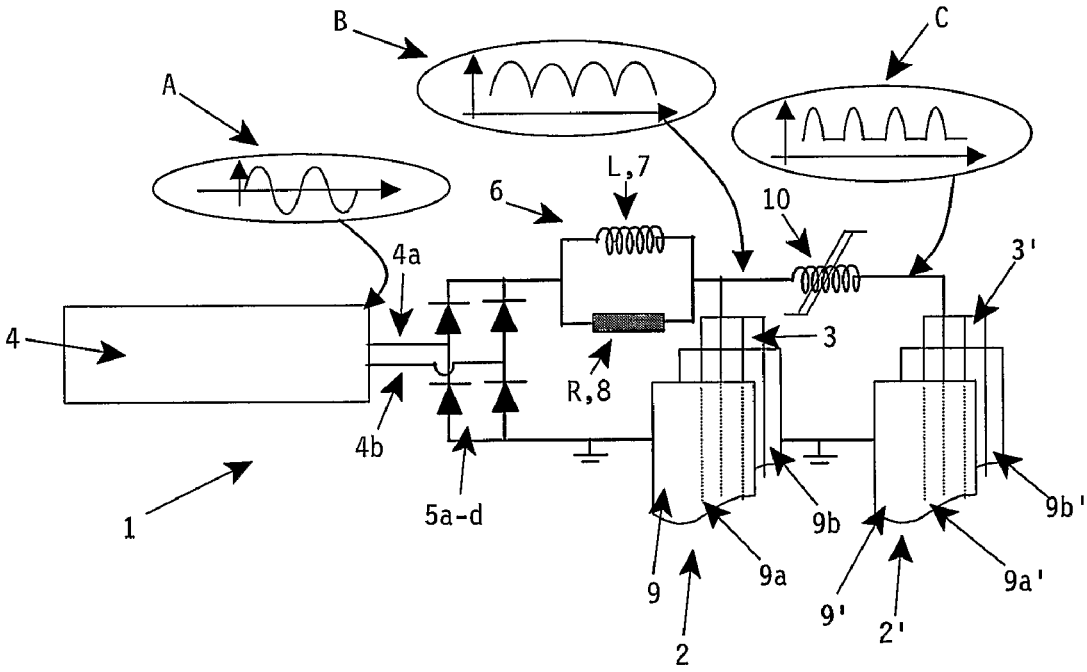

FIG. 3 shows yet another embodiment similar to the embodiment of FIG. 1, in which the element having diode functionality 5 is built up of several rectifiers 5*a*-5*d* and functions as a bridge rectifier. The signal A delivered by the high-voltage source 4 can be regarded as an AC voltage signal as shown in FIG. 3. Furthermore, the embodiment of FIG. 3 shows two assemblies 2-2', whose discharge electrodes 3-3' are electrically interconnected by means of a magnetic switching element 10.

Figure 4:
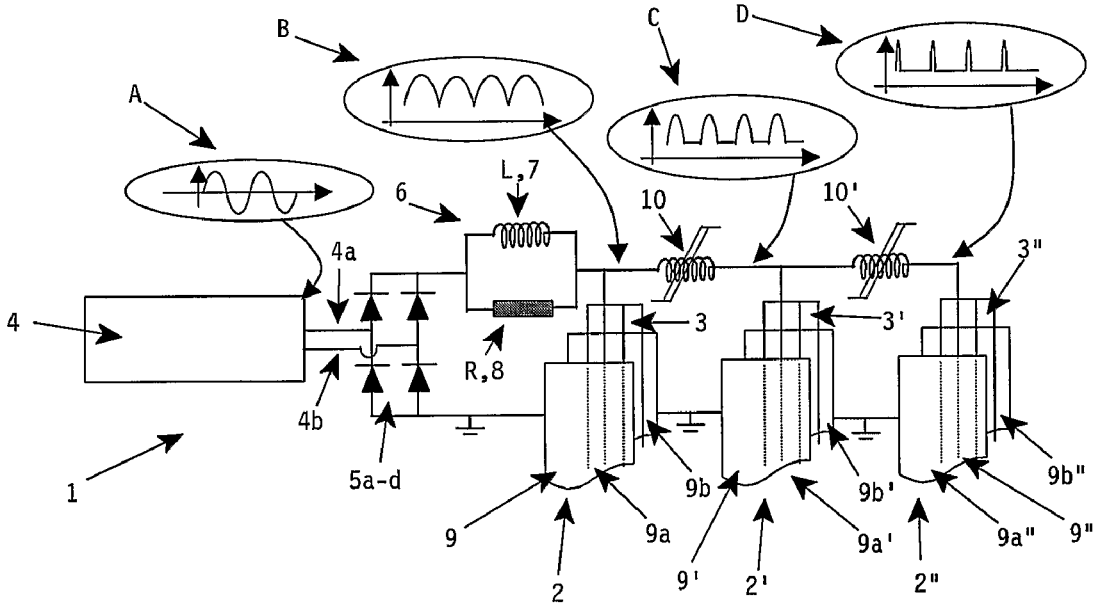

The embodiment of FIG. 4 is similar to the embodiment that is shown in FIG. 3, with this difference that the embodiment of FIG. 4 comprises another additional assembly 2", whose at least one discharge electrode 3" is electrically connected to the at least one discharge electrode 3' of the further assembly 2' via a further magnetic switching element 10'. The high-voltage source 4 as shown in the embodiments of FIGS. 3 and 4 is configured as a bipolar AC/DC pulse converter in this case. Analogously to the operation as shown in FIGS. 1 and 2, each magnetic switching element 10, 10' of the embodiments that are shown in FIGS. 3 and 4 is charged by the voltage signals B and C, respectively, being applied to the discharge electrodes 3 and 3', respectively, until they are saturated, so that the discharge electrodes 3 and 3', respectively, can discharge across the switching elements 10 and 10', respectively, to the successive assemblies 2' and 2", respectively. The various switching elements 10, 10' exhibit a high inductance level at the start of the discharging process.

Figure 5:
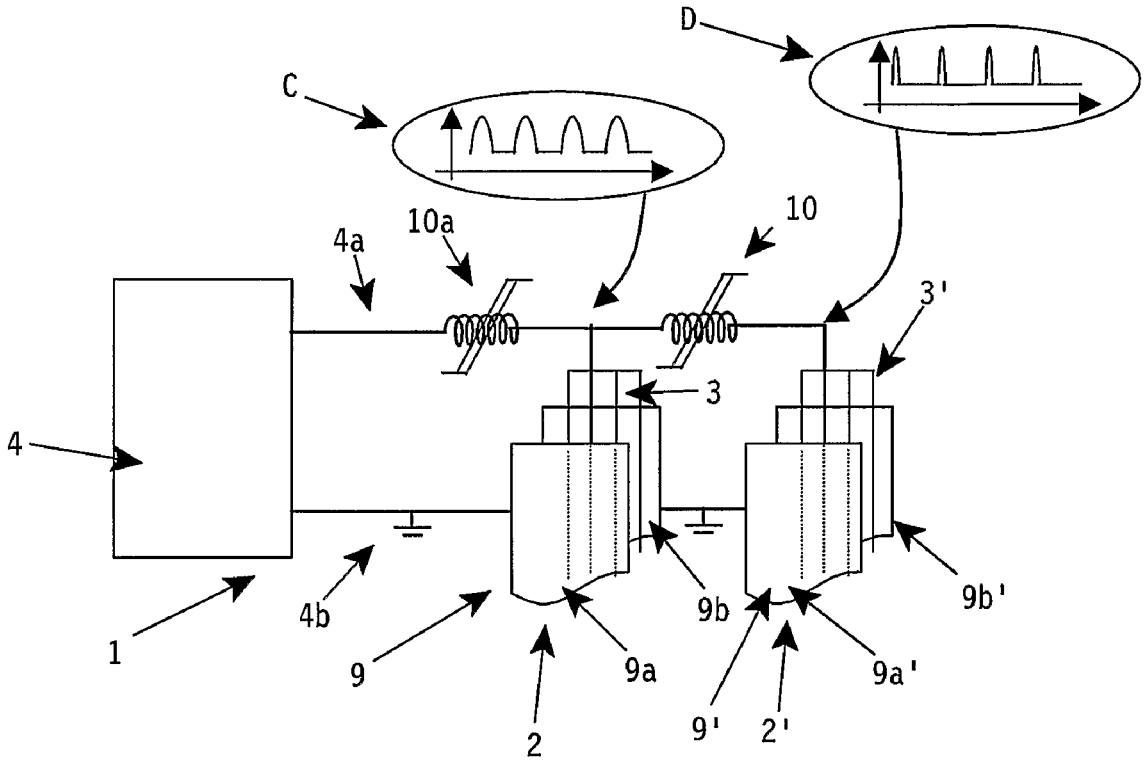
Figure 6:
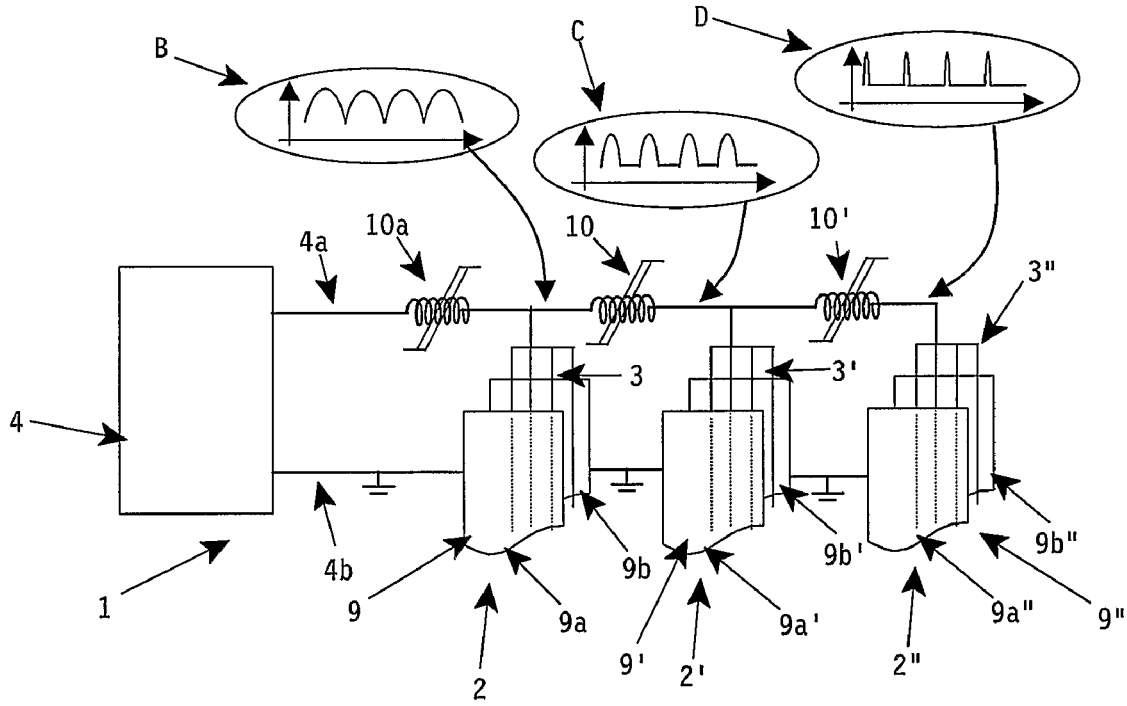

In the embodiment as shown in FIGS. 5 and 6, the high-voltage source 4 is an AC-DC pulse converter, which is connected, via the output terminal 4*a* and a magnetic switching element 10*a* according to the invention, to the at least one discharge electrode 3 of an assembly that is built up of at least one corona discharge space 9. In principle the magnetic switching element 10 is not charged yet at the start of the process, and consequently it exhibits a high inductance level. The essence of the embodiment that is shown in FIG. 5 is that the magnetic switching element 10*a* is directly charged by the high-voltage source 4 and discharges in the direction of the at least one discharge electrode 3 of the assembly 2 the moment it becomes saturated.

Likewise, the two discharge electrodes 3, 3' of the successive assemblies 2, 2' are electrically interconnected by means of a magnetic switching element 10 according to the invention. The voltage signal D has a shorter pulse time than the AC voltage signal C that is applied to the at least one discharge electrode 3 of the assembly 2.

In corresponding embodiments as shown in FIG. 6, the apparatus 1 according to the invention comprises an additional assembly 2", whose at least one discharge electrode 3" is electrically connected to the at least one discharge electrode 3' of the further assembly 2' by means of a further magnetic switching element 10'. In this embodiment, too, the voltage signal D that is applied to the at least one discharge electrode 3" has a shorter pulse time than the voltage signal C that is applied to the at least one discharge electrode 3' of the further assembly 2', which voltage signal C in turn has a shorter pulse time than the AC voltage signal B that is applied to the at least one discharge electrode 3 of the assembly 2 by the high-voltage source 4 and the magnetic switching element 10*a*.

Figure 7:
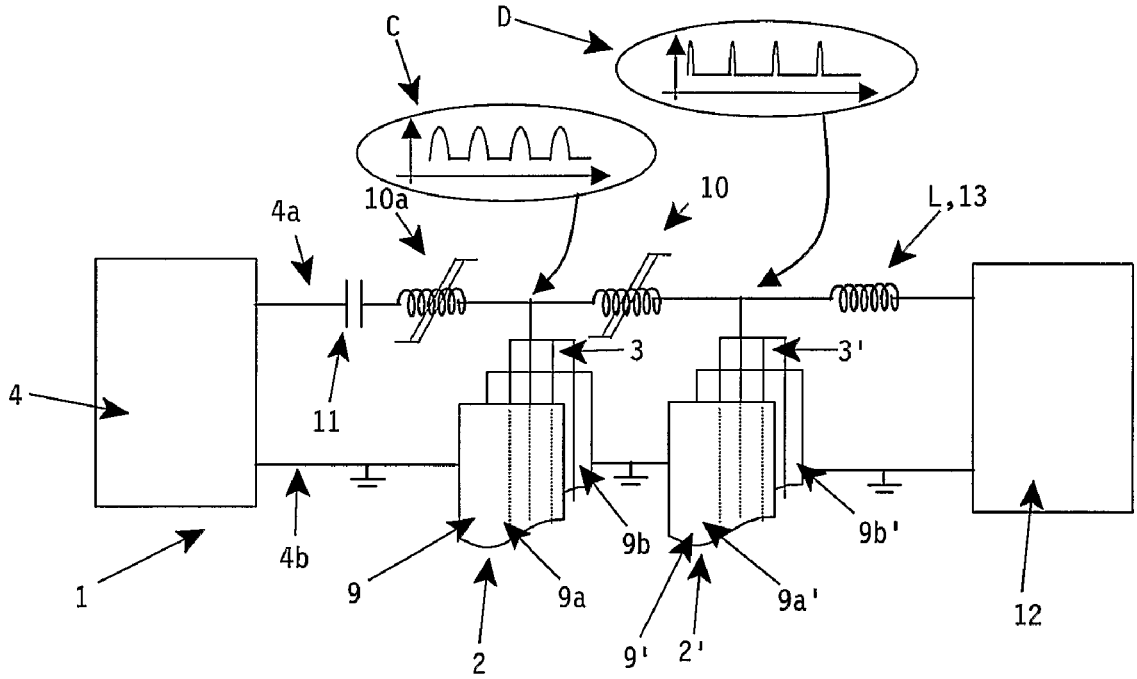
Figure 8:
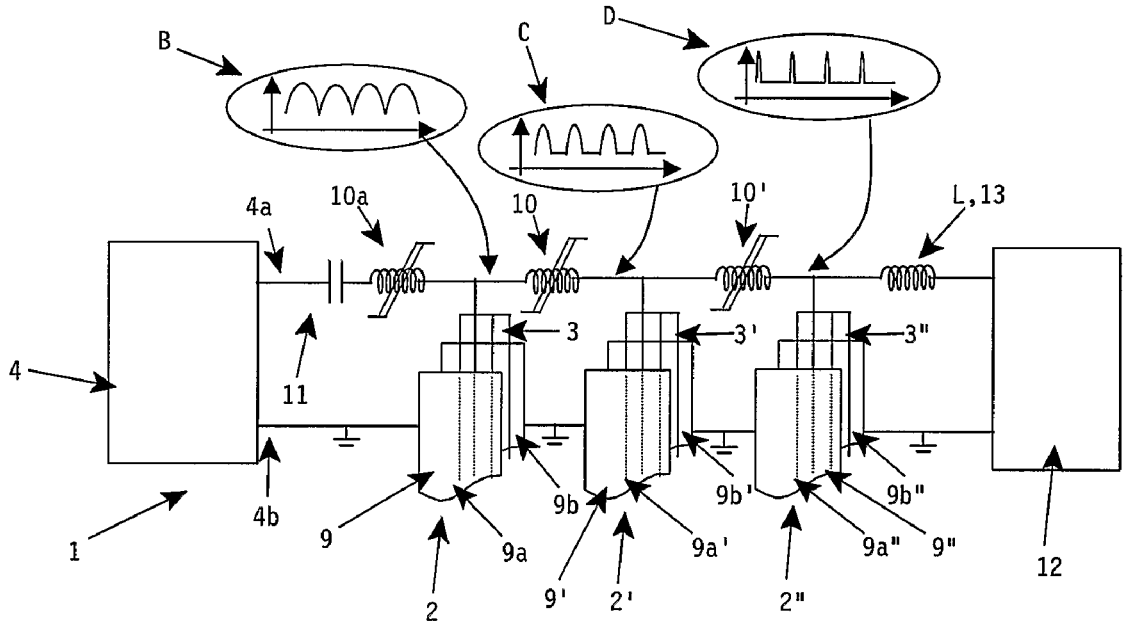

In two further embodiments as shown in FIGS. 7 and 8, the apparatus 1 according to the invention comprises a DC voltage source 12 which is connected to at least one discharge electrode 3', 3" of a respective further assembly 2', 2" in the embodiment that is shown in FIGS. 7 and 8. As is clearly shown in the two embodiments of FIGS. 7 and 8, the pulse time of the successive AC voltage signals A-B-C progressively decreases, in the sense that each signal has a pulse time shorter than that of the preceding signal.

According to the invention, the DC voltage source 12 is furthermore connected to the at least one discharge electrode 3', 3" by means of a coupling inductor. The inductance L of the coupling inductor 13 ranges from 1 mH to 1000 mH. The coupling inductor 13 blocks the frequencies in the high-voltage signals for the DC voltage source 12 and thus prevents the DC voltage source 12 from being influenced or damaged by the frequency pulses of the AC high-voltage signal or the pulsed high-voltage signal delivered by the high-voltage source 4.

In FIGS. 7 and 8, the high-voltage source is an AC/DC pulse converter, which is electrically connected to the further magnetic switching element 10*a* by means of a coupling capacitor 11. The capacitance C of the coupling capacitor 11 preferably ranges from 2 nF to 100 nF. The coupling capacitor 11 realises a DC high-voltage component in combination with the DC voltage source 12, on which the high-voltage source 4A superposes an AC high-voltage component or a pulsed high-voltage component.

The pulse converter 4 first energizes the assembly 2 via the coupling capacitor 11 and the further magnetic switching element 10*a*. At the end of the charging process, the switching element 10 becomes saturated, after which the at least one discharge electrode 3 discharges to the further discharge electrode 3' of the further assembly 2' via the switching element 10. Likewise, the voltage signal B charges the next magnetic switching element 10' which, once saturated, discharges to the next at least one discharge electrode 3" of the next assembly 2".

Figure 9:
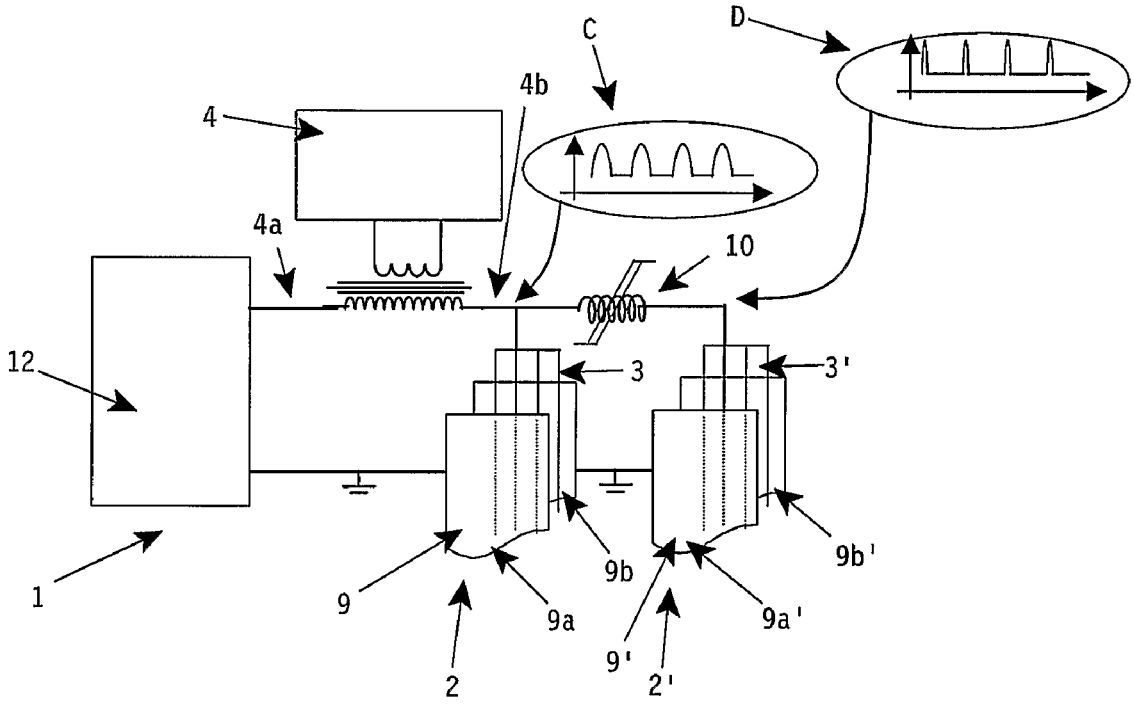
Figure 10:
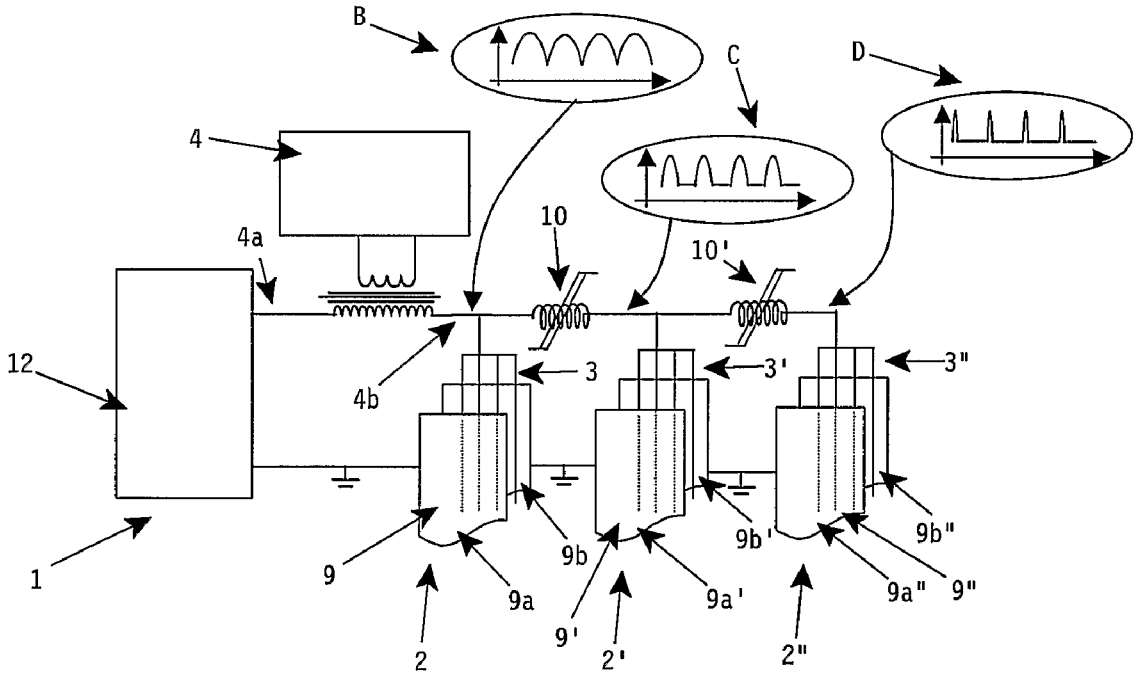
Figure 11:
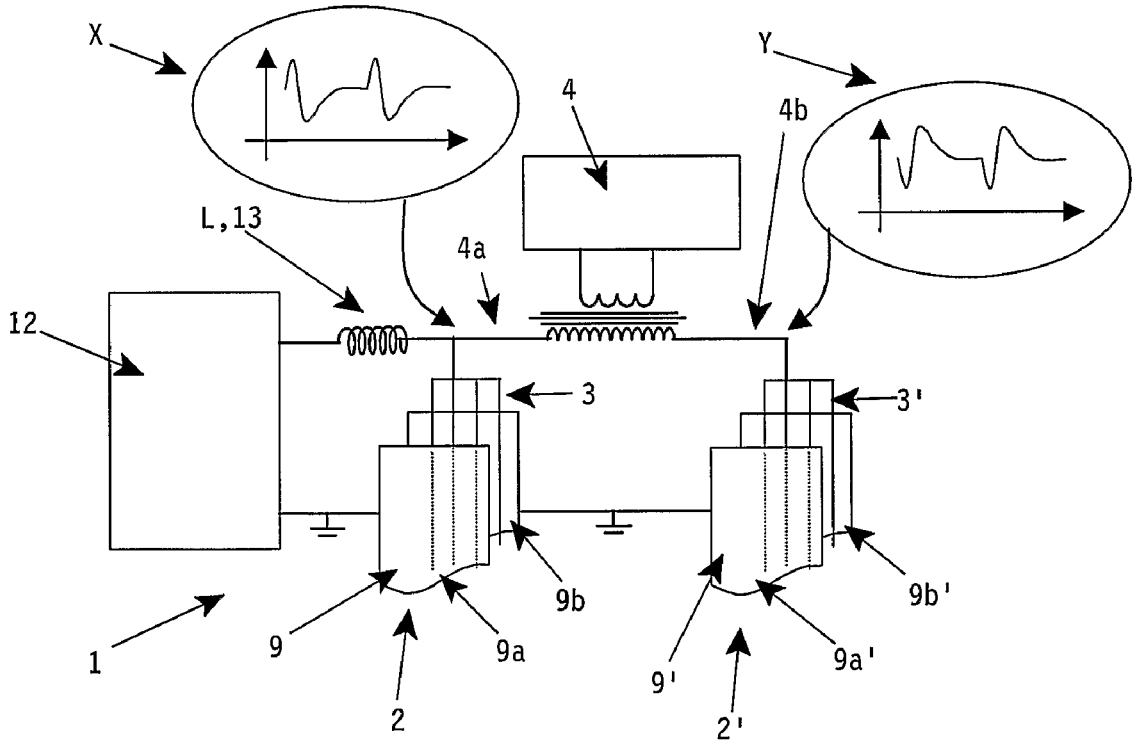

FIGS. 9 and 10 disclose two further embodiments based on an inductive coupling with a DC voltage source 12 and an AC/DC pulse converter connected in series therewith, which applies an AC voltage signal C to the at least one discharge electrode 3 of the first assembly 2. Initially, the magnetic switching element 10 that electrically connects the at least one discharge electrode 3 of the first assembly 2 to the at least one discharge electrode 3' of the further assembly 2' is not charged yet and exhibits a very high inductance level.

Once charged, the magnetic switching element 10 is saturated and discharges to the at least one discharge electrode 3' of the further assembly 2' in the form of an AC voltage signal D, which exhibits a much shorter pulse time than the AC voltage signal C being applied to the at least one discharge electrode 3 of the first assembly 2 by the AC/DC pulse converter via the output terminal 4*b*.

The embodiment that is shown in FIG. 10 is identical to the embodiment that is shown in FIG. 9, with this difference that the apparatus 1 that is shown in FIG. 10 comprises an additional assembly 2" whose at least one discharge electrode 3" is electrically connected to the at least one discharge electrode 3' of the further assembly 2' by means of an additional magnetic switching element 10'. The voltage signal D applied to the at least one discharge electrode 3" exhibits a shorter pulse time than the voltage signal C.

The embodiments as shown in FIGS. 11 and 12 again use a DC voltage source 12 as well as an AC/DC pulse converter 4, which drives the at least one discharge electrode 3, 3' of a first assembly 2 and the further assembly 2', respectively, by means of the voltage signals X and Y, respectively, via the output terminals 4*a* and 4*b*, respectively. The pulse converter 4 drives the various assemblies 2-2' alternately and thus functions as the (magnetic) switching element according to the invention. When the discharge electrode 3' of the further assembly 2' is driven (positive peak in the signal Y), the signal X exhibits a negative peak (no driving/discharging of the discharge electrode 3 of the first assembly 2) that corresponds therewith in time.

The DC voltage source 12 is furthermore electrically connected to the output terminal 4*a* of the AC/DC pulse converter 4 and to the at least one discharge electrode 3 of the first assembly 2 by means of a coupling inductor 13. The inductance L of the coupling inductor 13 ranges from 1 mH to 1000 mH.

In this case, too, the coupling inductor 13 blocks the frequencies in the high-voltage signals for the DC voltage source 12 and thus prevents the DC voltage source 12 from being influenced or damaged by the AC high-voltage signal or the pulsed high-voltage signal delivered by the high-voltage source 4.

Figure 12:
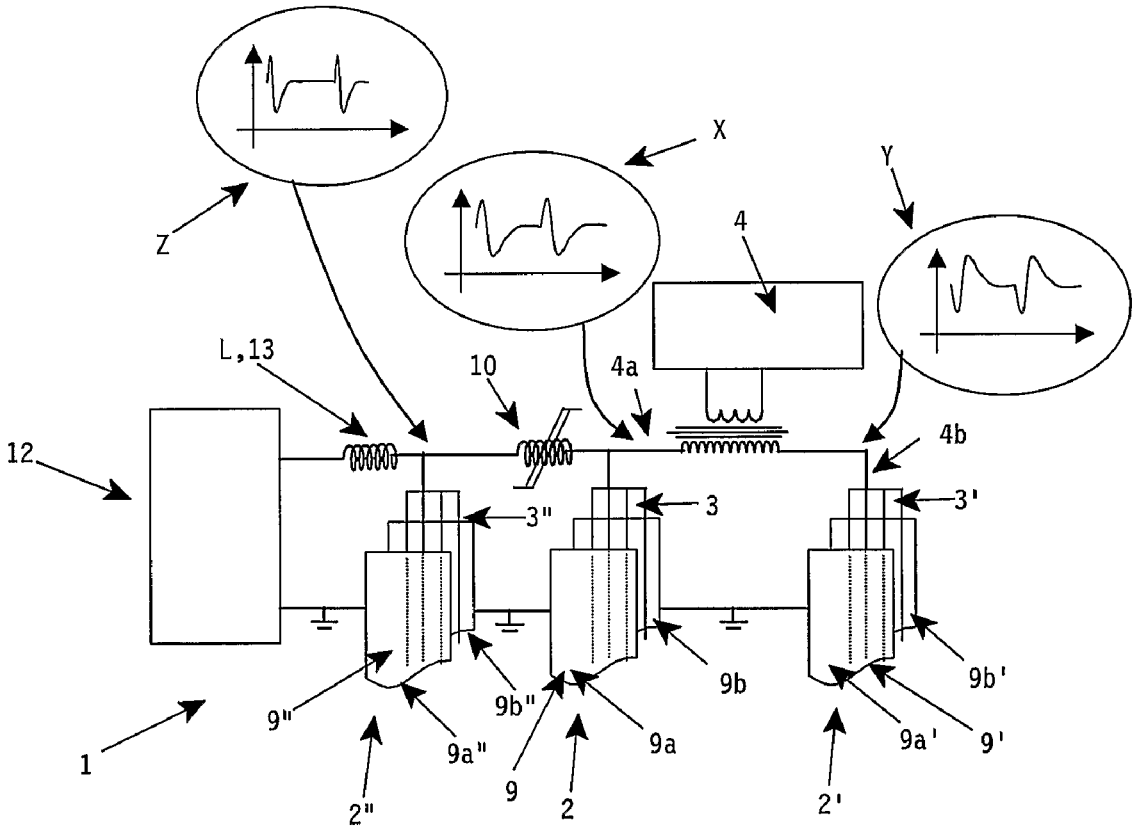

In the embodiment that is shown in FIG. 12, the apparatus 1 comprises an additional assembly 2 whose at least one discharge electrode 3 is connected to the at least one discharge electrode 3' of the first assembly 2' by means of a magnetic switching element according to the invention.

The winding ratio of the inductively coupled pulse converter 4 that is used in FIGS. 9-12 ranges between 1 and 100.

The configuration as shown in FIGS. 1-12 makes it possible to control several corona discharge spaces 9, using a standard high-voltage source 4 having standard specifications and the magnetic switching element 10 according to the invention, making it possible to upscale the apparatus 1 to higher power levels. Furthermore this makes it possible to increase the spatial dimensions of the corona discharge spaces 9, using the configurations that are shown in FIGS. 1-12, by upscaling the surface area of the plate members 9*a*-9*b* or using several plate members 9*a*-9*b*-9*c*- etc, in which case one or more discharge electrodes 3 are provided between the plate members.

The invention claimed is:

1. An apparatus for generating corona discharges, comprising:

a first assembly defining at least one corona discharge space and comprising at least one discharge electrode disposed in the corona discharge space;

a first switching element; and a high voltage source, an output of which is connected to the at least one discharge electrode, wherein the apparatus comprises at least one second assembly connected in series with said first assembly, the second assembly defining least one second corona discharge space and comprising at least one second discharge electrode disposed in the corona discharge space; and the at least one discharge electrodes of the respective assemblies are electrically interconnected by means of the first switching element.

2. An apparatus according to claim 1, wherein the first switching element is configured as a magnetic switching element.

3. An apparatus according to claim 2, wherein the magnetic switching element comprises a magnetic core material and one or more electrical windings wound around the core.

4. An apparatus according to claim 3, wherein the magnetic core material is pre-magnetised.

5. An apparatus according to claim 4, wherein the pre-magnetisation of the magnetic core material is adjustable.

6. An apparatus according to any one of the claim 1, further comprising a second switching element connected between the high-voltage source and the at least one discharge electrode of the first assembly.

7. An apparatus according to claim 6, comprising a coupling capacitor connected between the high-voltage source and the second switching element.

8. An apparatus according to claim 7, wherein the capacitance C of the coupling capacitor ranges between 2 nF and 100 nF.

9. An apparatus according to claim 1, further comprising a DC voltage source connected to one of the discharge electrodes.

10. An apparatus according to claim 9, further comprising a coupling inductor connected between the DC voltage source and at least one of the discharge electrodes.

11. An apparatus according to claim 10, wherein the inductance L of the coupling inductor ranges from 1 mH to 1000 mH.

12. An apparatus according to claim 9, wherein the high-voltage source comprises an inductive coupling pulse converter.

13. An apparatus according to claim 12, wherein a winding ratio of the inductive coupling pulse converter ranges between 1 and 100.

14. An apparatus according to claim 12, wherein the inductive coupling pulse converter is connected between at least one of the discharge electrodes and the DC voltage source.

15. An apparatus according to claim 1, further comprising a diode connected between the high-voltage source and the at least one discharge electrode of the first assembly, the diode delivering a positive DC high-voltage component with an AC high-voltage component superposed thereon to the at least one discharge electrode of the first assembly.

16. An apparatus according to claim 15, wherein the diode comprises one of a rectifier, a transistor, or a thyristor.

17. An apparatus according to claim 15, wherein the diode is configured as a single-phase rectifier.

18. An apparatus according to claim 15, wherein the diode is configured as a bridge rectifier.

19. An apparatus according to claim 15, comprising an LR circuit, wherein the diode is connected in series with the LR-circuit, and the LR-circuit is connected to the at least one discharge electrode of the first assembly.

20. An apparatus according to claim 15, wherein the DC high-voltage component is 10-60 kV.

21. An apparatus according to claim 20, wherein the DC high-voltage component is 5-35 kV.

22. An apparatus according to claim 15, wherein the frequency of the AC high-voltage component is 0.1-100 kHz.

23. An apparatus according to claim 22, wherein the frequency of the AC high voltage is 5-30 kHz.

24. An apparatus according to claim 1, wherein the high-voltage source comprises an AC/DC pulse converter.

25. An apparatus according to claim 1, wherein the high-voltage source comprises an AC/DC/AC converter.

26. An apparatus according to claim 1, comprising at least two parallel, electrically earthed plates within each corona discharge space, between which earthed plates the at least one discharge electrode extends in parallel relationship therewith.

* * * * *